US007141927B2

(12) United States Patent
Manning

(10) Patent No.: US 7,141,927 B2
(45) Date of Patent: Nov. 28, 2006

(54) ARC LAMP WITH INTEGRATED SAPPHIRE ROD

(75) Inventor: William L. Manning, Walpole, MA (US)

(73) Assignee: Perkinelmer Optoelectronics, Salem, MA (US)

( * ) Notice: Subject to any disclaimer, the term of this patent is extended or adjusted under 35 U.S.C. 154(b) by 30 days.

(21) Appl. No.: 11/031,213

(22) Filed: Jan. 7, 2005

(65) Prior Publication Data

US 2006/0152128 A1 Jul. 13, 2006

(51) Int. Cl.
*H01J 5/16* (2006.01)
*H01J 61/54* (2006.01)

(52) U.S. Cl. ..... 313/573; 313/601; 313/113

(58) Field of Classification Search ..... 313/110–113, 313/568, 570–572, 634, 636, 2, 567, 573, 313/601, 602

See application file for complete search history.

(56) References Cited

U.S. PATENT DOCUMENTS 3,770,338 A * 11/1973 Helmuth ..... 385/88
3,808,496 A 4/1974 McRae et al. ..... 313/113
4,823,043 A 4/1989 Roberts et al. ..... 313/231.61
5,721,465 A 2/1998 Roberts ..... 313/46
6,114,807 A 9/2000 Kavanagh ..... 313/570
6,181,053 B1 1/2001 Roberts ..... 313/46
6,268,697 B1 * 7/2001 Nishida et al. ..... 313/607
6,274,970 B1 8/2001 Capobianco ..... 313/113
6,316,867 B1 11/2001 Roberts et al. ..... 313/113
6,339,279 B1 1/2002 Miyamoto et al. ..... 313/113
6,400,067 B1 6/2002 Manning et al. ..... 313/46
6,561,675 B1 5/2003 Kavanagh ..... 362/263
6,597,087 B1 7/2003 Roberts et al. ..... 313/113
2003/0090902 A1 5/2003 Kavanagh ..... 362/263
2003/0193281 A1 10/2003 Manning ..... 313/113

* cited by examiner

*Primary Examiner*—Ashok Patel
(74) *Attorney, Agent, or Firm*—Stallman & Pollock LLP

(57) ABSTRACT

A pulsed discharge arc lamp can utilize an integrated optical adapter assembly to ease the coupling of an optical fiber to the lamp. An optical rod of the assembly allows for a precise positioning of the output, and acts as an integrating rod whereby the output is transformed to a relatively diffuse, uniform, and stabilized circular beam of light. The optical adapter assembly helps to reduce the presence of intensity peaks in the UV spectrum, making the output more uniform over the entire spectrum of the lamp.

36 Claims, 7 Drawing Sheets

- Prior Art -

ARC LAMP WITH INTEGRATED SAPPHIRE ROD

TECHNICAL FIELD OF THE INVENTION

The present invention relates generally to light sources and particularly to arc lamps and methods of manufacturing such lamps.

BACKGROUND

Conventional arc lamps provide a high energy density, high intensity, sharply defined source which is desirable in a number of applications. The high energy density and high intensity of pulsed short arc flashlamps, otherwise known as bulb-type flashtubes, for example, are desirable in analytical applications such as absorption spectroscopy where the chemical sensitivity is a direct function of the energy density at the target sample, as well as applications such as fluorometry and HPLC applications. Flashlamps in general are arc lamps that operate in a pulsed mode and are capable of converting stored electrical energy into intense bursts of radiant energy covering the ultraviolet (UV), visible, and infrared (IR) regions of the spectrum. The combination of an unconfined arc and short arc length result in a low impedance device capable of producing microsecond pulse durations, typically between 0.7 and 10 μs. With these short pulse durations, flash repetition rates of up to 300 Hz are readily obtainable. The high level of flash-to-flash stability needed for many applications, such as instabilities of 0.25% or less, is obtained through the spatial stability of the arc discharge and the total spectral stability of the light output of the flashlamp. The time jitter typically is less than 150 ns, with a recovery time of the discharge on the order of about 150 μs. Descriptions of such arc lamps can be found, for example, in U.S. Pat. No. 6,274,970, which is hereby incorporated herein by reference.

FIG. 1 shows an exemplary short arc flashlamp 100 of the prior art having a lamp housing consisting of a cylindrical metal or glass enclosure 102, otherwise known as a can or envelop. A window 106 is positioned near a circular opening 104 at a transmitting end of the envelope. A stem 108 is secured at the opposite end of the envelop 102, and a weld or braze ring 110 can be used to connect the stem 108 to the envelop by a process such as arc welding. The sealed envelope can be filled with a pressurized, inert gaseous atmosphere, such as an atmosphere containing xenon gas at about 3 atm. Flashlamps are similar to other arc lamps in that optical radiation is produced when sufficient energy is transferred to the gas atoms to cause excitation and ionization. Xenon is used in most flashlamps since xenon is thought to be the most efficient of the inert gases for converting electrical energy to optical energy. Inside the sealed interior of the lamp are positioned an anode 112 and a cathode 114, connected by stem pins 116 and 118, respectively, to the stem 108. The stem pins pass through the stem to allow a voltage to be applied across the arc gap formed between the electrodes by an appropriate circuit (not shown). Current typically is supplied by a capacitor discharging large amounts of energy in a short period of time. The anode and cathode are configured to allow for an arc discharge in the sealed envelope when the capacitor in the circuit discharges across the gap.

The alignment of the electrodes is critical for efficiency and stability. At least one trigger probe 120 is positioned near the arc gap between the anode 112 and the cathode 114 to guide the arc. The trigger probe can be coupled with a trigger electrode 122 for passing a high voltage trigger pulse near the arc gap, creating a low impedance path between the anode and cathode such that the voltage capacitor can discharge across the gap. The number of trigger probes can depend on the arc length and type of flashlamp. A sparker electrode 124 is positioned inside the envelope for generating a preionization of the gas, in order to obtain a more uniform discharge. The discharge across the arc gap can generate light that is reflected by a mirror assembly 126 positioned relative to the arc gap and/or transmitted through the light transmitting window 106. The mirror assembly can have a cavity 128 made of a material such as stainless steel, copper, or glass, which can hold a drop-in reflector or have a material coating thereon acting as the reflector. The alignment of the mirror also can be critical for efficiency. The window assembly 126 also can include an exhaust pipe 128.

Many applications utilize external optical fibers to couple light from these lamps to the appropriate location. Bundles of glass or fused silica fibers are typically positioned adjacent the output window of the lamp to capture the transmitted light. This approach can be somewhat troublesome, however, as it can be difficult to precisely position the fiber bundle relative to the location of the discharge. This positioning can involve operating the lamp for a number of discharges and moving the input end of the fiber transversely across the window exit surface in order to find the optimal position, or "sweet spot," relative to the discharge. This process can be time consuming, imprecise, and can lower the amount of manufacturing throughput. Further, such alignment may need to be readjusted due to movement or operation of the lamp.

Another problem with these existing arc lamps is the inherent instability. When a discharge pulse occurs between the two main electrodes, the resultant explosion, though somewhat controlled, will have certain fluctuations in parameters such as position and spectral intensity. The resultant instabilities can be propagated through the fiber bundle, and can produce an output beam of light that is unacceptable for many high-precision applications.

Further still, existing approaches to utilizing fiber optic illumination with an arc lamp source require elements such as an optical chain, at least one lens, and at least one optical filter to transfer the light from the lamp. At any of these optical elements, as well as at the window of the lamp itself, the illumination can experience various reflective and transmissive losses. These losses can have undesirable effects upon the end application, such as various biomedical applications

DETAILED DESCRIPTION

Figure 1:
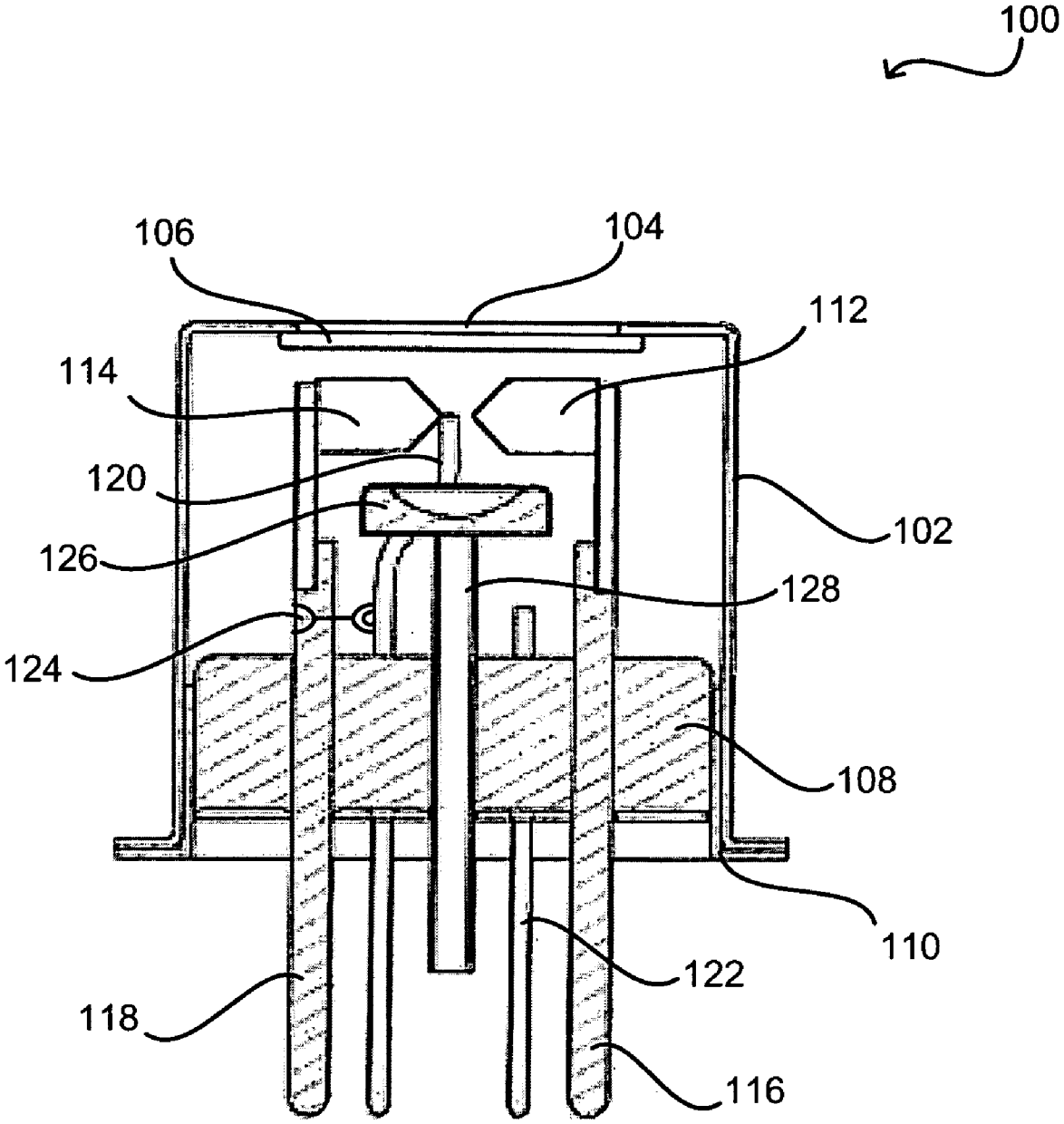
FIG. 1 is a cross-section diagram of an arc lamp of the prior art.

Systems and methods in accordance with various embodiments of the present invention overcome these and other problems with existing arc lamps by changing the way in which light is coupled out of the lamps. For example, a pulsed discharge arc lamp 200 in accordance with one embodiment is shown in the cross-section of FIG. 2. A pulsed discharge lamp such as that shown in FIG. 2 can be operated in any orientation, and is not limited in orientation as some continuous operation lamps. In this embodiment, a spark gap is again created between the anode 202 and the cathode 204 in the metal can 206. The lamp includes several components described with respect to FIG. 1, including stem pins 220, 222 connecting the anode and cathode to the stem 240, a sparker assembly 224, a mirror assembly 230 including exhaust pipe 232, and a trigger probe 226 and probe electrode 228. In order to allow for an easy alignment of an output optical fiber 234 relative to the discharge, an optical adapter assembly 208 can be used in place of a standard output window. The adapter assembly can include a cylindrical adapter chamber 210 having a first cylindrical bore 214 of a diameter sufficient to accept an end of an optical fiber or fiber bundle (not shown), and to position that end relative to the area of the discharge between the electrodes.

The adapter chamber 210 also can have a second bore 218, of a diameter that typically is smaller than the diameter of the first bore, having essentially the same central axis as the first bore and passing through the adapter as an opening into the interior of the metal envelop 206. The diameter of the second bore can be selected to allow for the acceptance of an optical rod 212, or light-transmitting elongated member, made of a material such as sapphire, which can be positioned to pass light from the interior of the metal envelop 206 to the input end of the optical fiber. The optical rod can extend from the exterior of the lamp housing, through a hole or opening in the lamp housing, and into the interior of the lamp housing. In other embodiments, an end of the optical rod may be flush with a wall of the lamp housing, extending only into or out of the lamp housing. In still other embodiments, the rod can be positioned entirely inside or outside of the lamp housing depending upon the configuration of the optical adapter assembly, as long as the rod can couple light from the discharge to an optical fiber (or other optical element) for directing light outside the lamp housing, while still improving the uniformity across the spectrum of the lamp.

The adapter chamber 210 also can have a connector region 242, such as a threaded connection region for receiving a complimentary threaded region 238 of an optical cable housing 236 surrounding the optical fiber 234. The adapter chamber can be designed such that when an optical cable is connected thereto, the optical fiber 212 inside the optical cable is brought to a desired position relative to an output end of the optical rod 212.

For simplicity the lamp will be described with respect to the use of a sapphire rod and a common optical fiber, but it should be understood that there can be many other elements and devices capable of transmitting light in accordance with embodiments of the present invention that would be obvious to one of ordinary skill in the art in light of the description herein. A sapphire rod can be preferred for many embodiments as sapphire provides the desirable transmittance and sealing capabilities, while capable of being brazed into the adapter assembly 208. Sapphire can pass the entire spectrum of the lamp, such as a spectrum on the order of about 190 nm to about 4000 nm. Methods and devices for sealing sapphire also are well known in the art.

Materials such as quartz may not be desirable, as it can be difficult to braze a quartz rod to the adapter chamber to make a hermetic seal. Other exotic materials can be used, but these materials can be quite difficult and/or expensive to seal. Materials such as magnesium fluoride or ruby can be used, but can be more expensive and/or difficult to produce. The sapphire rod can have appropriate processing of the surface, such as a cylindrical side surface that is ground and polished to easily fit into the second bore of the adapter housing and to substantially prevent interference with the light propagating within. The sapphire rod also can have an appropriate surface finish placed on each end that allows for the acceptance and transmittance of light without substantially altering the light.

An adapter ring 216, such as a weld ring or weld adapter, can be used to connect the adapter housing to the metal envelop by any appropriate means, such as brazing or arc welding, and can be used to seal the lamp. The end of the adapter chamber 210 having the second bore therein can be flush with the adapter ring, or can extend down into the interior of the metal envelope 206 as discussed below. The adapter chamber can be positioned such that when an optical rod 212 (or other transmissive object) is positioned with an input end that is substantially flush with the end of the chamber, the input end of the optical rod is the desired distance from the arc gap. The optical rod 212 can be positioned to be at a central location with respect to the electrodes, or can be positioned at any appropriate location where a maximum and/or uniform intensity (sometimes referred to as the "sweet spot" of the discharge) is obtained.

A sapphire rod can have any appropriate dimensions, but in one embodiment is approximately 0.040" in diameter, and on the order of 0.20"–0.40" in length. In an embodiment for a 3 mm lamp, the optical rod has a diameter of approximately 0.10". The diameter of the rod can be selected to be large enough to accept a sufficient amount of light from the discharge, and any reflection of the discharge by the mirror assembly, but small enough to allow substantially all the collected light to pass into the optical fiber. The input end of the sapphire rod can be positioned in the vicinity of the discharge, such as a distance of 0.040"–0.050" away from the discharge. The output end of the sapphire rod 212 can be positioned to be approximately flush with the transition between the first and second bores of the adapter chamber 210, in order to allow the fiber to easily be brought into abutting contact with the sapphire rod. The first and second bores can have precise diameters such that when a sapphire rod and fiber are received into the bores, the sapphire rod and fiber are precisely placed with respect to the discharge and no additional alignment tooling or process is necessary.

The length of the rod also can be selected such that the rod can serve as an "integrating cylinder" or "integrating bar" for the transmitted light. As known in the art, an integrating cylinder can filter out much of the instabilities in the light from a distinct source, here the arc plasma, thereby producing a relatively diffuse, uniform, and stabilized beam of light that is circular in nature. The output end of the sapphire rod then can be used as a focus point for additional optics elements, providing a very stable virtual light source at an image plane defined by the output end of the optical rod. This stable light source also can be coupled to optics other than an optical fiber, allowing for the improved lamp to be coupled to any of a number of other applications and/or devices. The optical rod essentially smoothes out spectral features in the transmitted light, providing a more uniform output intensity across the wide spectral range of the lamp, which can be a range of the order of about 150 nm to about 4000 nm for a typical xenon lamp discharge. Configuring the sapphire rod to smooth the spectral features can improve the stability of the output light by an order of 10–20 fold.

Figure 2:
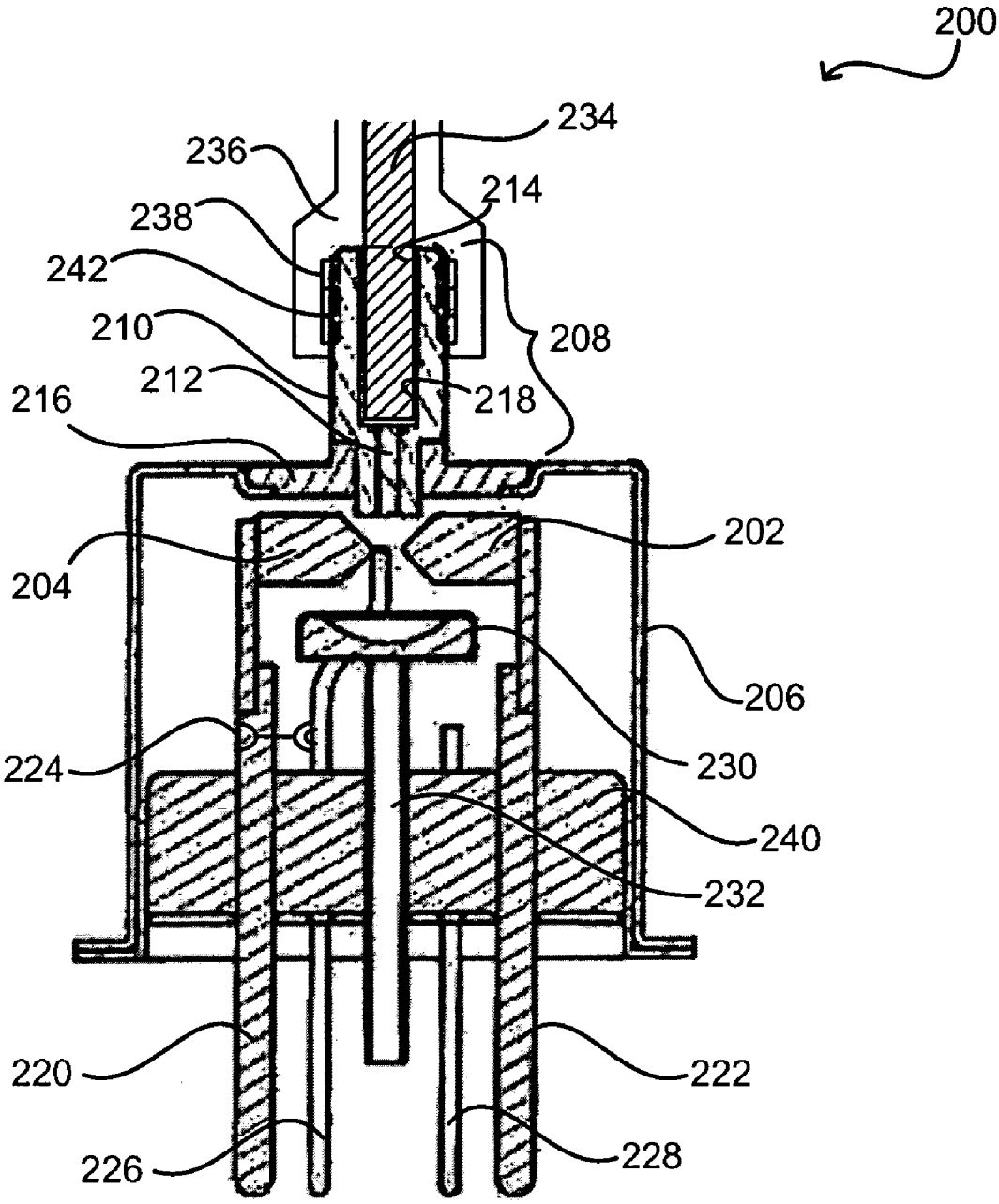
FIG. 2 is a side-view cross-section diagram of an arc lamp in accordance with one embodiment of the present invention.
Figure 3A:
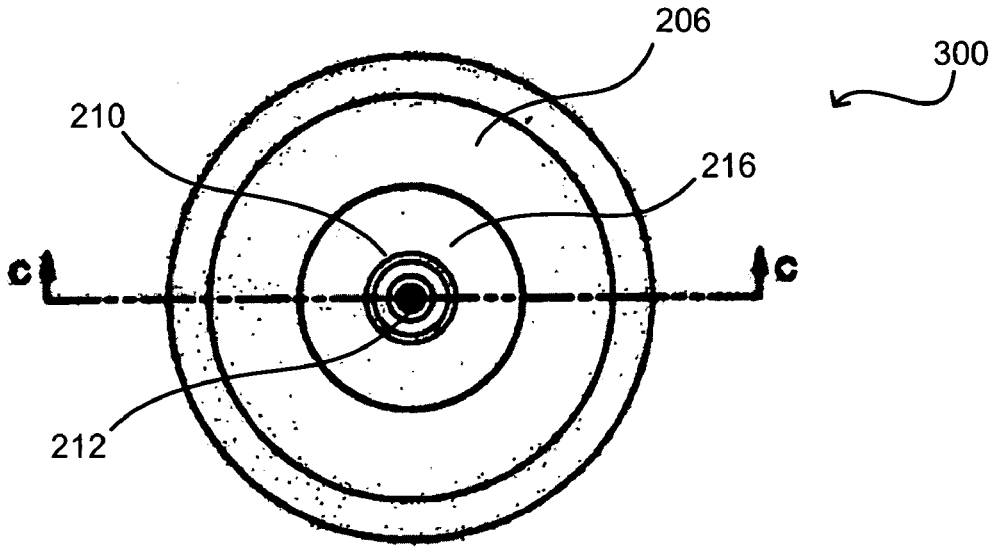
FIG. 3 is (a) a top-view diagram and (b) a side-view cross-section diagram of a metal envelop with adapter assembly in accordance with one embodiment of the present invention.
Figure 3B:
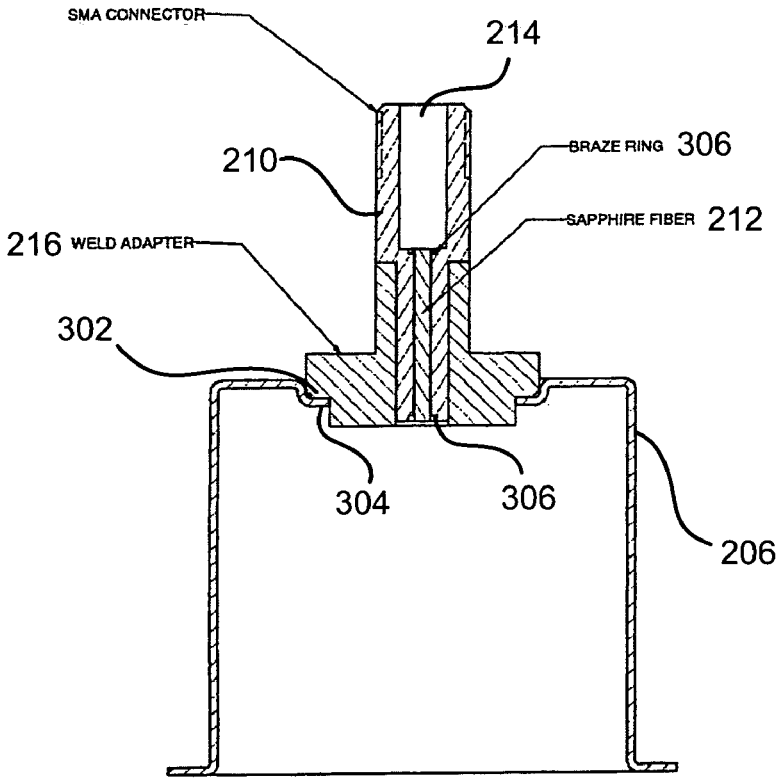
Figure 4A:
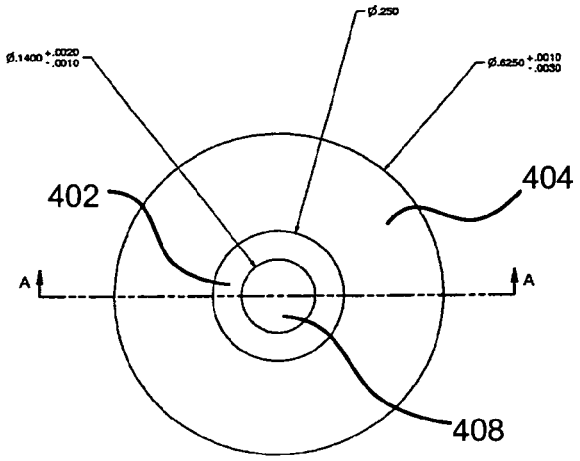
FIG. 4 is (a) a top-view diagram, (b) a perspective view diagram, and (c) a side-view cross-section diagram of an adapter ring in accordance with one embodiment of the present invention.
Figure 4B:
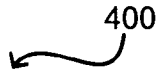
Figure 4B:
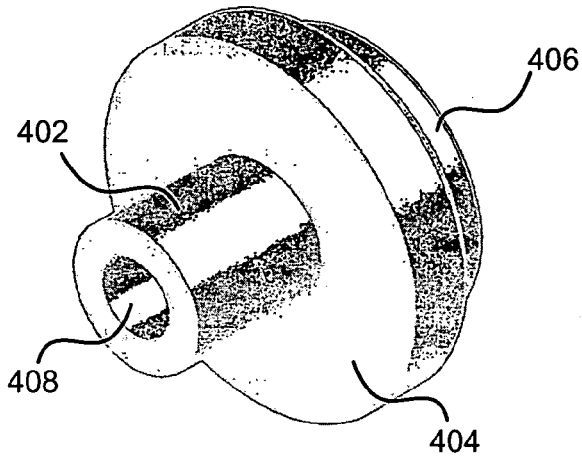
Figure 4C:
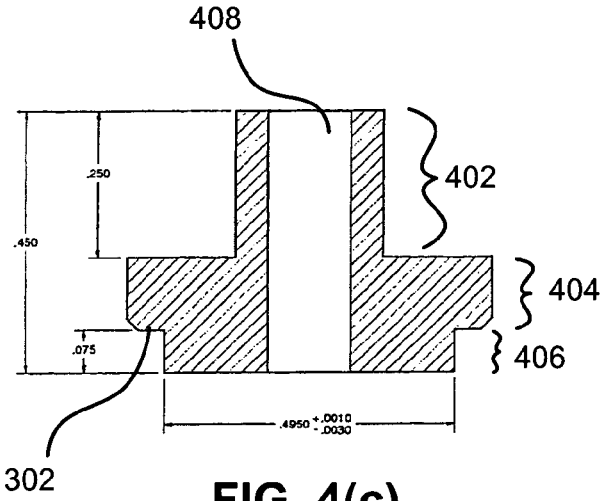

FIG. 3 shows a subassembly 300 of the lamp of FIG. 2, including an optical adapter assembly that can be used to replace the window in an existing arc lamp while still allowing for a hermetic seal of the lamp. Reference numbers will be carried over between figures where appropriate for simplicity, but should not be interpreted as a limitation on any given embodiment. In this subassembly, the adapter ring 216, or weld adapter, is shown to have a circumferential flange region 302 shaped to sit within a circular recess 304 of the metal can 206. The flange of the adapter ring and recess of the metal can allow the adapter ring 302 to be precisely positioned relative to the metal can 206. The flange and recess also allow for an ease of connection using a connection such as a BT braze as known in the art. At least one braze ring 306 can be used to connect the optical rod to the optical adapter assembly as discussed below.

A closer view of an exemplary adapter ring 400 is shown in FIG. 4. This adapter ring 400 has an approximate height of 0.450" and approximate width of 0.625". As seen in the figure, this adapter ring 400 can be discussed as having three regions of differing diameter, namely an extension portion 402, a receiving portion 404, and a protruding portion 406. As discussed with respect to FIG. 3, the receiving portion 404 includes the circumferential flange 302 for seating the adapter ring with respect to the metal can. The flange can have any approximate dimension capable of supporting and sealing the adapter assembly with respect to the metal can, shown here to extend 0.065" on either side of the protrusion portion 406. The protrusion portion 406 is that portion of the adapter ring that protrudes down into the metal can and is exposed to the lamp gas. As shown in FIG. 3, the outer edge of the protrusion portion can be machined to be flush with the ends of the adapter chamber and sapphire rod. As such, the distance to which the protrusion portion extends down into the metal envelope can be determined by the proximity of the arc gap and the desired separation between the discharge and the sapphire rod. The exemplary adapter ring of FIG. 4 has a protrusion portion that is about 0.495" in diameter and extends down by about 0.075". The actual separation between the end of the protrusion portion and the discharge can be determined by the location of the discharge and the thickness of the recess in the metal can.

The adapter also has an extension portion 402 for receiving the adapter chamber 210. The extension portion can extend away from the receiving portion 404 by an amount that allows for a precise and strong support of the adapter chamber relative to the metal can. The extension portion is shown to extend approximately 0.25" away from the receiving portion, with a diameter of approximately 0.25". The extension portion also has an adapter bore 408 for receiving a portion of the adapter chamber 210. The adapter bore can have an inner diameter that is approximately the same as the outer diameter of that portion of the adapter chamber, shown in this example to be about 0.14".

Figure 5A:
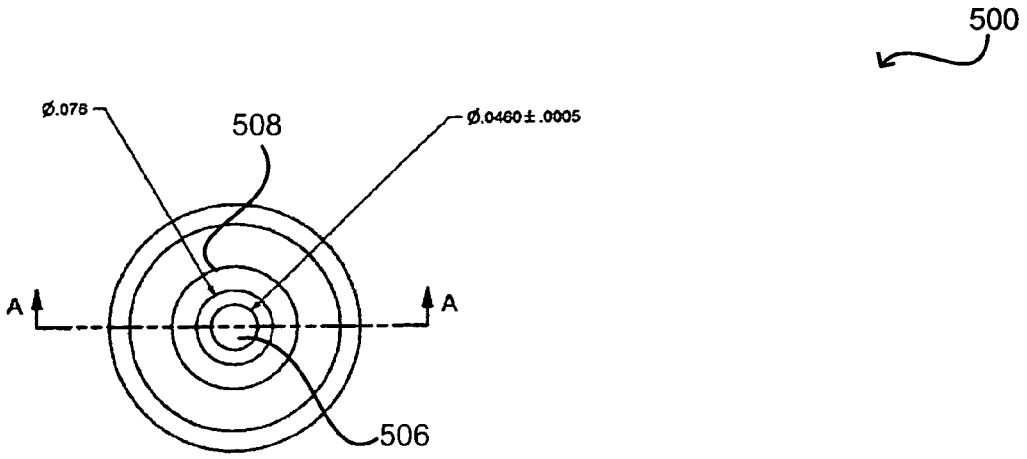
FIG. 5 is (a) a top-view diagram, (b) a perspective view diagram, and (c) a side-view cross-section diagram of an adapter chamber in accordance with one embodiment of the present invention.
Figure 5C:
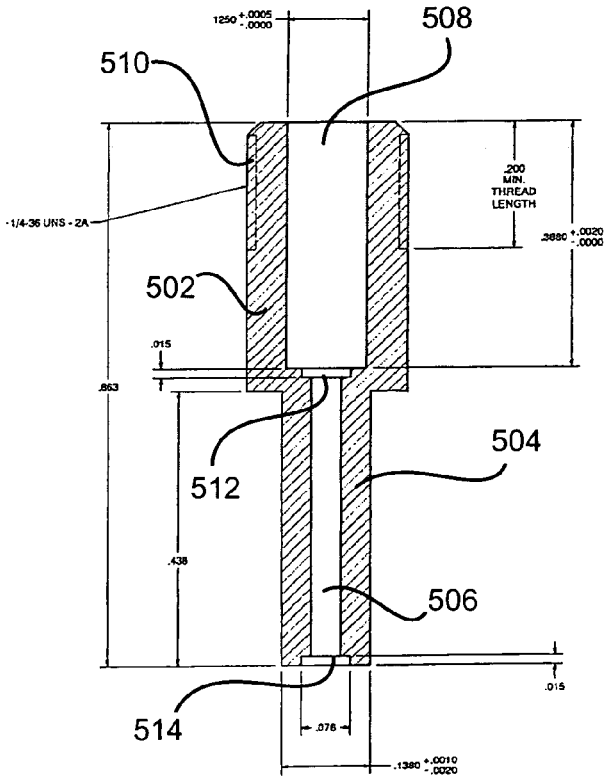
Figure 5B:
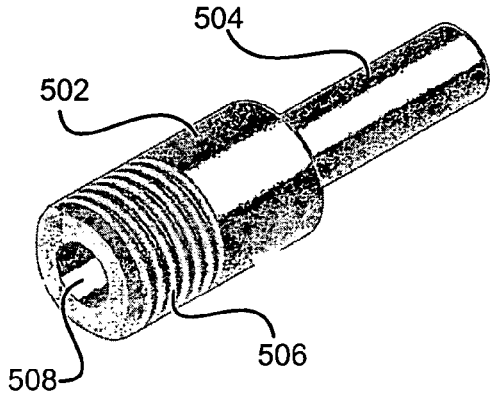

As seen in FIG. 3, the adapter ring can be welded into the recess area of the metal can 206, providing a precise positioning of the adapter bore. Into the adapter bore can be placed the shaft portion of the adapter chamber 210, whereby the adapter chamber can be laser welded to the adapter ring. FIG. 5 shows a detailed view of an exemplary adapter chamber 500 having a head portion 502 and a shaft portion 504, wherein the shaft portion can be received by the adapter bore 408 of the adapter ring 400. The shaft portion 504 can have an outer diameter that fits within the adapter bore of the adapter ring, while still providing support for the optical rod to be placed therein. In the example of FIG. 5, the shaft has an outer diameter of about 0.138" and a length of about 0.438". The shaft portion 504, and typically a portion of the head portion 502, can include the second bore 506, discussed above, sized to receive an optical rod, such as a 0.040" diameter sapphire rod that is 0.445" in length. At each end of the second bore 506 the adapter chamber can include a circumferential groove 512, 514 for a braze ring, which can allow for brazing to connect the optical rod to the adapter chamber, as well as to hermetically seal the rod into the chamber 500. The head portion 502 can have appropriate dimensions to allow for the connection of a standard optical cable. For example, the head portion of FIG. 5 has a length of 0.425" and includes an STM threaded connector region 510 of 0.200" minimum thread length allowing for the connection of a standard fiber optic cable. The head portion also includes the first bore 508 discussed above, which has a length allowing the optical fiber to extend to approximately the output end of the optical rod when connected to the adapter chamber 500 using the threaded connector region. The first bore can have an inner diameter allowing for the passage of a standard optical fiber or fiber bundle, such as a diameter on the order of about 0.125". The precise positioning of the optical rod integrated within the second bore, as well as the positioning of the standard optical fiber, allows for an ease of connection with no need for positioning and/or adjustment of the fiber and/or the connector. Further, the use of an optical rod having a diameter on the order of about 0.040" eliminates the need for light shielding from the remainder of the arc. The resultant small source spot size helps to improve the pulse to pulse stability of the lamp. This approach also can provide direct coupling of an external fiber without incurring the losses otherwise obtained through use of various optics and the lamp window in existing approaches.

Figure 6A:
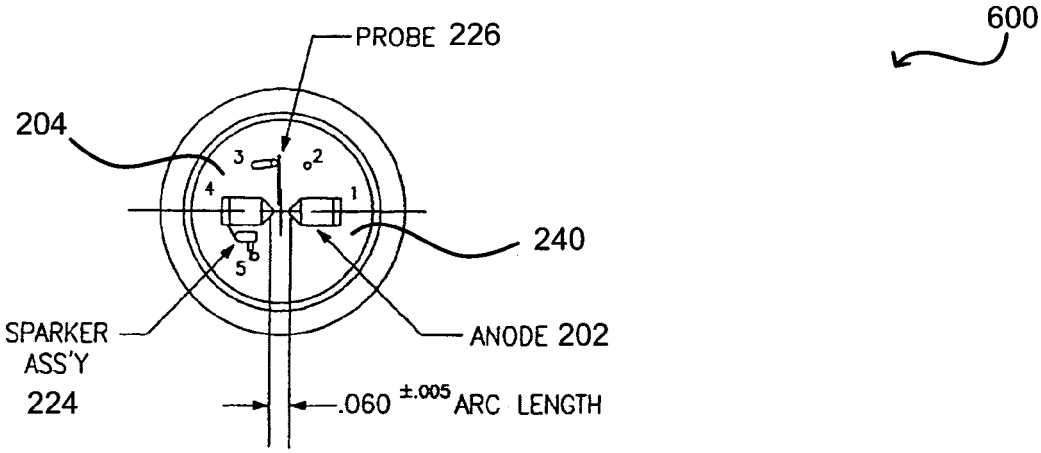
FIG. 6 is (a) a top-view diagram, (b) a first side-view cross-section diagram, and (c) a second side-view cross-section diagram of an electrode assembly in accordance with one embodiment of the present invention.
Figure 6B:
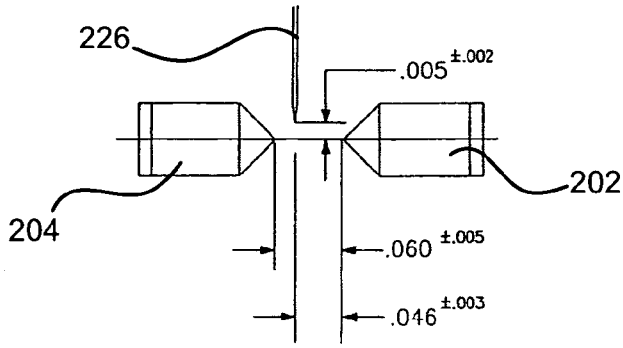
Figure 6C:
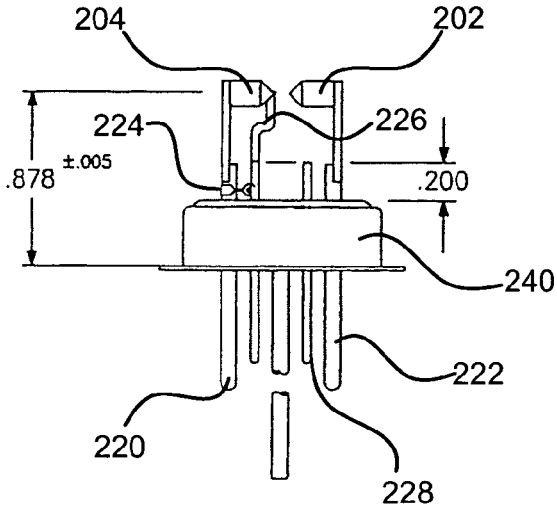

FIG. 6 shows a more detailed view of an exemplary electrode subassembly 600 that can be positioned into the subassembly of FIG. 3 to form a sealed pulse discharge arc lamp. As discussed above, this subassembly can be used with the metal can to form a xenon flashlamp having a probe-guided discharge. The subassembly of FIG. 3 can be designed in a number of embodiments to work with an existing electrode subassembly, in order to reduce the design and manufacturing costs of the resultant lamps. The anode 202 and cathode 204 electrodes, the triggering probes 226, 228, and the sparker assembly 224 can be fabricated to the lamp in any conventional manner known and/or used in the art. As shown, the spark gap between the electrodes can be on the order of about 0.060", with the first probe 226 being positioned a distance of about 0.046" away from the anode 202. The probe, which is essentially a thin pole, can come into proximity of the discharge at about a 90° angle, and can be approximately the same height as the electrodes. The probe can be used to trigger the discharge as discussed above. The sparker assembly 224 is located near the bottom of the cathode post, a typical assembly including a sparker circuit and firing sequence. As the firing begins, a trigger voltage breaks down the sparker, creating photons that enhance the discharge. This creates a pre-ionization of the lamp gas to enhance stability. The probe assembly 226 has trigger potential placed thereon, such that a very low energy, high voltage energy spike applied to the probe can create a short circuit between the anode and cathode. The short circuit can occur across the electrodes in microseconds, allowing the charging capacitor to discharge across that short circuit between the electrodes.

A problem with the discharge from such an electrode subassembly, however, is that the discharge tends to expand over time. As this expansion results in light that may not be effectively coupled out of the lamp, this can result in a decrease in efficiency whether or not an optical rod is used. Further, the plasma tends to cool as the arc expands, further reducing efficiency. One approach is to place a magnetic discharge around the arc in order to confine the expansion. In accordance with various embodiments of the present invention, however, it has been determined that an easy way to confine the expansion is to increase the pressure inside the lamp. People typically have avoided increases in pressure, using an internal pressure of only about 3 atm, as increased pressure increases the likelihood of explosion and/or injury during operation of the lamp. It has been found, however, that these lamps can withstand a pressure of about 20 atm in one example. These lamps also can experience an increase in efficiency on the order of 30–35% simply by increasing the inner pressure to about 10 or 11 atm. In one example, a lamp was vacuum processed and baked out at 400° C., then backfilled with approximately 11 atm of xenon gas. The higher gas pressure essentially contained the expansion of the plasma during operation, confining the arc discharge. The higher pressure also was found to provide broadening throughout the spectrum of the lamp. The benefits to use of a higher pressure were especially noticeable in the UV region of the spectrum, where these lamps tend to experience a substantial amount of intensity spiking. As the pressure increased, the peaking was significantly reduced. Further, a substantial amount of line broadening was obtained, as well as a significant increase in output throughout the spectrum.

In order to further improve the performance of these lamps, an optical coating such as a magnesium fluoride thin film can be placed on the surfaces along the optical path, such as at the input end of the optical rod or the input surface of the lamp window (where used). Another coating can be used to filter peaks over a certain range of the spectrum, such as over the UV range. The coating in one embodiment tends to reflect and/or absorb light in the UV region. When used in combination with an increase in pressure, some peaks in the spectrum can be reduced due to the pressure, the coating, or a combination thereof, producing a much more uniform discharge over the entire spectrum of the lamp. This can be beneficial especially when these lamps are used with equipment such as spectrometers, radiometers, or HPLC equipment, where a wide spectral range such as between 190 nm and 800 nm is being used. Further, a lamp in accordance with embodiments of the present invention has been shown to have a peak current that is on the order of 10–15% less than for existing lamps. The reduction in peak current is another indication of the increased efficiency.

Figure 7A:
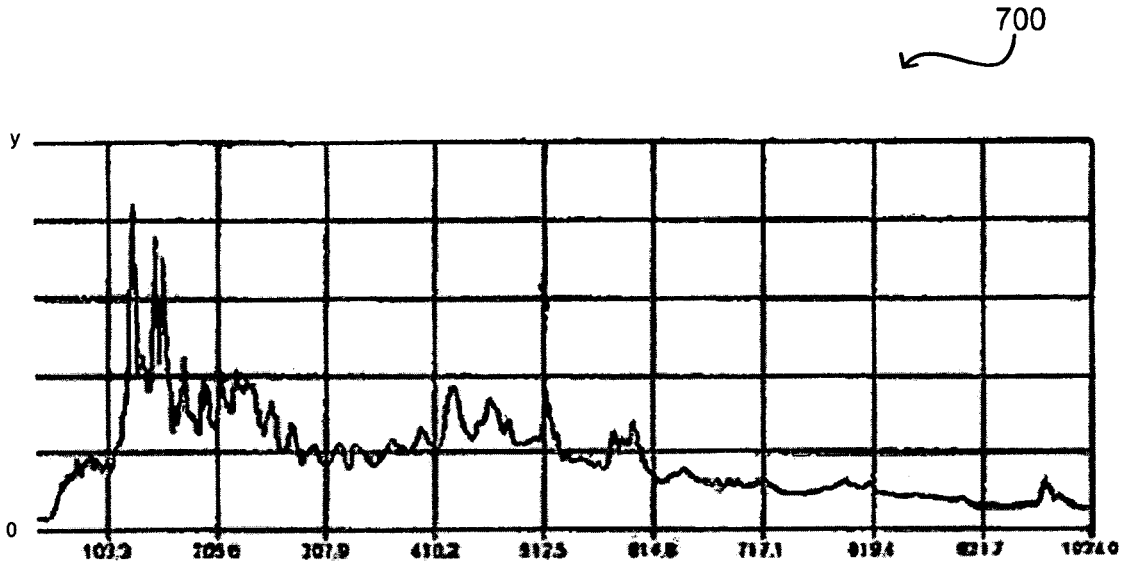
FIG. 7 is a plot showing the output intensity over a wide spectral range of (a) an existing lamp and (b) an exemplary lamp in accordance with one embodiment of the present invention.
Figure 7B:
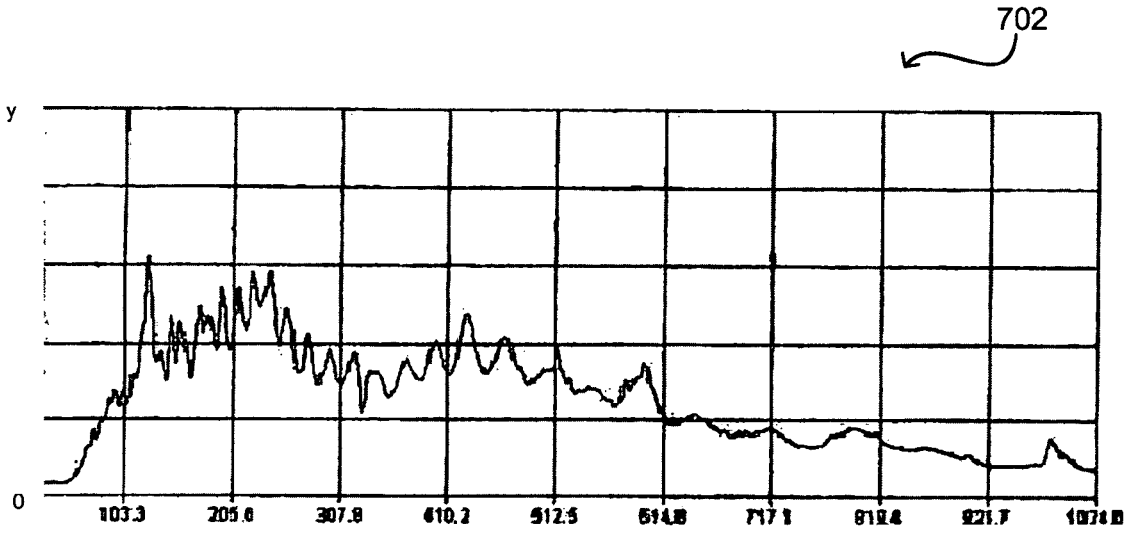

For example, FIG. 7 shows the spectrum for an exemplary lamp using (a) a standard window assembly and (b) an optical rod assembly with increased pressure and optical coating. FIG. 7(*a*) shows the shape of the spectrum 700 for an existing lamp to have much higher peaks in the UV region than in the visible region of the spectrum. Currently, customers using these lamps must adjust their equipment to balance this non-uniformity. It can be necessary to coat the sapphire for different wavelengths in an attempt to get the same energy level across the entire spectrum.

FIG. 7(*b*) shows the spectrum 702 for a lamp in accordance with one embodiment of the present invention. It can be seen this spectrum is much more uniform, and does not demonstrate the intense peaks in the UV region. A lamp in accordance with embodiments of the present invention does not require a user to compensate for spectrum non-uniformities, eliminating many of the balancing headaches experienced with existing lamps.

It should be recognized that a number of variations of the above-identified embodiments will be obvious to one of ordinary skill in the art in view of the foregoing description. Accordingly, the invention is not to be limited by those specific embodiments and methods of the present invention shown and described herein. Rather, the scope of the invention is to be defined by the following claims and their equivalents.

What is claimed is:

1. An arc lamp, comprising:

a sealed beam arc lamp having an anode and a cathode forming an arc gap inside a lamp housing, said lamp housing including a metal can;

an optical assembly integrated in the arc lamp, the optical assembly including an optical rod passing through an opening in the lamp housing, the optical rod having an input end positioned relative to the arc gap such that light generated by a discharge across the arc gap is transmitted through the optical rod to the exterior of the lamp housing; and a weld adapter having a circumferential flange region shaped to sit within a circular recess of the metal can, whereby the optical assembly is precisely positioned relative to the arc gap in the metal can.

2. An arc lamp according to claim 1, wherein:

the optical rod extends into the interior of the lamp housing.

3. An arc lamp according to claim 1, wherein:

at least a portion of the optical rod extends outside the lamp housing.

4. An arc lamp according to claim 1, wherein:

the optical rod is oriented along an axis that is substantially orthogonal to the direction of the discharge across the arc gap.

5. An arc lamp according to claim 1, wherein:

the optical rod extends from the exterior of the lamp housing through the opening in a wall of the lamp housing to an input point near the discharge across the arc gap.

6. An arc lamp according to claim 1, wherein:

the optical rod is separated from the anode and cathode.

7. An arc lamp according to claim 1, wherein:

the optical rod is a sapphire rod.

8. An arc lamp according to claim 1, wherein:

the optical rod is between about 0.040" and 0.100" in diameter and between about 0.20" and 0.40" in length.

9. An arc lamp according to claim 1, wherein:
the arc lamp is a pulsed discharge, short arc lamp.

10. An arc lamp according to claim 1, wherein:
the optical assembly includes an adapter chamber having a first bore for accepting an optical fiber, and a second bore for accepting the optical rod, wherein the first and second bores have a common central axis.

11. An arc lamp according to claim 10, wherein:
the second bore is positioned to ensure a fixed spatial relationship between the optical rod and the discharge.

12. An arc lamp according to claim 10, wherein:
the adapter chamber includes a connector region allowing for the connection of an optical cable, the optical cable having an optical fiber positioned in the first bore of the optical chamber whereby light transmitted by the optical rod is received by an input end of the optical fiber.

13. An arc lamp according to claim 12, wherein:
the connector portion is an STM threaded connector region.

14. An arc lamp according to claim 10, wherein:
the optical assembly includes at least one braze ring allowing the optical rod to be brazed into the optical chamber, hermetically sealing the rod into the chamber.

15. An arc lamp according to claim 1, wherein:
the optical rod is oriented along an axis that is substantially orthogonal to the direction of the discharge across the arc gap.

16. An arc lamp according to claim 1, wherein:
the optical rod is oriented along an axis that is substantially orthogonal to the direction of the discharge across the arc gap.

17. An arc lamp according to claim 1, wherein:
the optical assembly forms a hermetic seal for the arc lamp.

18. An arc lamp according to claim 1, wherein:
the optical rod is selected to pass a spectrum of the lamp on the order of about 190 nm to about 4000 nm.

19. An arc lamp according to claim 1, wherein:
the optical rod has a diameter selected to be large enough to accept a sufficient amount of light from the discharge and any reflection of the discharge by a mirror assembly, and small enough to allow substantially all the collected light to pass into any optical fiber connected thereto.

20. An arc lamp according to claim 1, wherein:
an input end of the optical rod is positioned a distance between about 0.040" and 0.050" away from the discharge.

21. An arc lamp according to claim 1, wherein:
the optical rod has a length sufficient to allow the optical rod to act as an integrating cylinder, whereby instabilities in light received from the discharge can be substantially reduced to produce a more diffuse, uniform, and stabilized beam of light that is circular in nature.

22. An arc lamp according to claim 21, wherein:
an output end of the optical rod serves as an illumination plane providing a very stable virtual light source for an external optical device.

23. An arc lamp according to claim 1, wherein:
a gas pressure inside the arc lamp is selected to substantially prevent expansion of the discharge during operation of the lamp.

24. An arc lamp according to claim 1, wherein:
a gas pressure inside the arc lamp is between about 10 atm and about 11 atm.

25. An arc lamp according to claim 1, wherein:
the arc lamp is filled with xenon gas.

26. An arc lamp according to claim 1, wherein:
a gas pressure inside the arc lamp is selected to provide line broadening throughout a spectrum of the arc lamp.

27. An arc lamp according to claim 1, further comprising:
an optical coating on an input end of the optical rod for filtering peaks over a predetermined spectral range of the lamp.

28. A xenon pulsed discharge arc lamp, comprising:
a metal can;
an electrode subassembly in the metal can including an anode and a cathode forming an arc gap; and
an optical assembly integrated with the metal can, the optical assembly including:
a sapphire rod having an input end positioned relative to the arc gap and an output end positioned at an exterior of the metal can, whereby light generated by a discharge across the arc gap is transmitted to the exterior of the metal can;
an adapter chamber housing the sapphire rod, the adapter chamber including a connector region for connecting an optical cable such that an optical fiber of the optical cable is positioned to receive light transmitted through the output end of the sapphire rod; and
a weld adapter for connecting the adapter chamber to the metal can and hermetically sealing the metal can, the weld adapter including a flange shaped to be received by a recess of the metal can in order to provide alignment of the sapphire rod relative to the discharge.

29. An arc lamp according to claim 28, wherein:
the sapphire rod extends into the interior of the lamp housing.

30. An arc lamp according to claim 28, wherein:
at least a portion of the sapphire rod extends outside the lamp housing.

31. An arc lamp according to claim 28, wherein:
the sapphire rod is oriented along an axis that is substantially orthogonal to the direction of the discharge across the arc gap.

32. An arc lamp according to claim 28, wherein:
the sapphire rod extends from the exterior of the lamp housing through the opening in a wall of the lamp housing to an input point near the discharge across the arc gap.

33. An arc lamp according to claim 28, wherein:
the sapphire rod is separated from the anode and cathode.

34. An arc lamp, comprising:
a sealed beam arc lamp having opposed, independent anode and cathode electrodes inside a lamp housing, the opposed anode and cathode electrodes forming an arc gap therebetween, said lamp housing including a metal; can and
an optical assembly integrated with the lamp housing, the optical assembly including an optical rod separate from the anode and cathode electrodes, the optical rod projecting from a wall of the lamp housing to be substantially perpendicular to the arc gap such that light generated by a discharge across the arc gap is transmitted through the optical rod to the exterior of the lamp housing, said optical assembly including a circumferential flange region shaped to sit within a circular recess of the metal can, whereby the optical assembly is precisely positioned relative to the arc gap in the metal can.

35. An arc lamp, comprising:

a sealed beam arc lamp having an anode and a cathode forming an arc gap inside a lamp housing;

an optical assembly integrated in the arc lamp, the optical assembly including an optical rod passing through an opening in the lamp housing, the optical rod extending into the housing and having an input end positioned relative to the arc gap such that light generated by a discharge across the arc gap is transmitted through the optical rod to the exterior of the lamp housing, the optical assembly including a first bore for accepting an optical fiber, and a second bore for accepting the optical rod, wherein the first and second bores have a common central axis and are arranged so that an output end of the optical rod is abutting contact with an input end of the optical fiber, and wherein the diameter of the optical rod is smaller than the diameter of the optical fiber.

36. An arc lamp, comprising:

a sealed beam arc lamp having an anode and a cathode forming an arc gap inside a lamp housing;

an optical assembly integrated in the arc lamp, the optical assembly including an optical rod passing through an opening in the lamp housing, the optical rod extending into the housing and having an input end positioned relative to the arc gap such that light generated by a discharge across the arc gap is transmitted through the optical rod to the exterior of the lamp housing, the optical assembly including a bore for accepting the optical rod and wherein each end of the bore includes a circumferential groove for receiving a braze ring for sealing the rod within the bore.

* * * * *